US006903501B2

(12) United States Patent
Kim

(10) Patent No.: US 6,903,501 B2
(45) Date of Patent: Jun. 7, 2005

(54) ELECTRON GUN ASSEMBLY FOR CATHODE RAY TUBE

(75) Inventor: Yoo-Seon Kim, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 137 days.

(21) Appl. No.: 10/611,352

(22) Filed: Jun. 30, 2003

(65) Prior Publication Data

US 2004/0061425 A1 Apr. 1, 2004

(30) Foreign Application Priority Data

Jun. 28, 2002 (KR) ..... 10-2002-0036668

(51) Int. Cl.[7] ..... H01J 29/50
(52) U.S. Cl. ..... 313/414; 313/446; 313/449
(58) Field of Search ..... 313/409, 414, 313/446, 449, 458, 447

(56) References Cited

U.S. PATENT DOCUMENTS 4,271,374 A 6/1981 Kimura
4,703,223 A * 10/1987 Iguchi et al. ..... 313/414
5,488,264 A * 1/1996 Ota et al. ..... 313/412
6,262,524 B1 * 7/2001 Ouchi ..... 313/414

* cited by examiner

*Primary Examiner*—Vip Patel
*Assistant Examiner*—Anthony Perry
(74) *Attorney, Agent, or Firm*—Christie, Parker and Hale, LLP

(57) ABSTRACT

An electron gun for a monochrome cathode ray tube to be used in a projection display device includes a cathode for emitting thermal electrons, and first and second electrodes forming a triode portion together with the cathode. A third electrode is adjacent the second electrode. A fourth electrode is adjacent the third electrode to receive a focus voltage. A fifth electrode partially surrounds the fourth electrode while being adjacent the fourth electrode to receive an anode voltage together with the third electrode. The second electrode has a bottom portion with a stepped portion surrounding a hole for guiding the electron beams while being protruded toward the first electrode, and a sidewall portion extended from the periphery of the bottom portion toward the third electrode. The first and the second electrodes are structured to satisfy the following condition: $0.54 \leqq T/G \leqq 1.50$ wherein T(mm) indicates the thickness of the bottom portion of the second electrode, and G(mm) indicates the distance between the first and the second electrodes.

20 Claims, 8 Drawing Sheets

ELECTRON GUN ASSEMBLY FOR CATHODE RAY TUBE

CROSS REFERENCE TO RELATED APPLICATION

This application claims priority to and the benefit of Korea Patent Application No. 2002-0036668 filed on Jun. 28, 2002 in the Korean Intellectual Property Office, the entire disclosure of which is incorporated herein by reference.

BACKGROUND OF THE INVENTION (a) Field of the Invention

The present invention relates to an electron gun assembly for a cathode ray tube (CRT) and, more particularly, to an electron gun well adapted for a monochrome CRT to be mounted within a projection display device to realize a monochrome image.

(b) Description of the Related Art

Generally, a CRT-based projection display device mainly has three monochrome CRTs for realizing red (R), green (G) and blue (B) monochrome images, and an optical system for amplifying the monochrome images made at the three CRTs and projecting the amplified images to a projection screen to produce color images.

As the monochrome CRT scans the display screen with one stream of electron beams, and the respective monochrome CRT screen images are projected to the projection screen while being amplified by about ten times, the brightness of the display screen related to the monochrome CRT is lower than that of the display screen related to the usual CRT. Therefore, compared to the usual CRT, relatively high electric currents need to be applied to the electron gun for the monochrome CRT to heighten the brightness of the display screen.

Usually, the electron gun for the monochrome CRT emits electron beams with the application of electric currents ranging from 0.5 mA to 3 mA, which are two or three times more than those applied to the electron gun for a usual color CRT ranging from 0.2 mA to 1 mA. A high unipotential focus (Hi-UPF) type exhibiting an excellent focus characteristic in the range of higher currents is commonly used for the monochrome CRT electron gun.

With the Hi-UPF type electron gun, the second electrode receives the screen voltage, and the fourth electrode receives the focus voltage. A third electrode is placed between the second electrode and the fourth electrode to receive a high anode voltage (roughly, 32 kV). A strong pre-focus lens is formed between the second and the third electrodes due to the high potential difference between the second and the third electrodes, and reduces the spot size of electron beams in the range of higher electric currents.

Further, the monochrome CRT electron gun serves to make formation of monochrome images practically under the application of electric currents of 2 mA or less. With the available electric current range of 0.5–3 mA, the Hi-UPF type electron gun exhibits an excellent focus characteristic in the higher current range of more than 2 mA. By contrast, in the relatively lower current range of 2 mA or less, it turns out that the spot size of electron beams is increased.

The increase in the beam spot size occurs because when the electron

The increase in the beam spot size occurs because when the electron beam current is lowered, the crossover point of the electron beams formed at the triode portion moves from the second electrode to the third electrode, and the emission power of the electron beams incident upon the pre-focus lens is weakened. Consequently, with the electric current range of 2 mA or less, the spot size of the electron beams is increased while deteriorating the resolution, resulting in unclear display images.

In order to reduce the beam spot size with the current range of 2 mA or less, it has been proposed that the size of the beam-guide hole formed at the first electrode be reduced. However, this reduction makes the area of electron emission for the cathode so small that the life span of the electron gun with the cathode is reduced.

U.S. Pat. No. 4,271,374 discloses a CRT electron gun with a structure where the equivalent diameter of the main-focus lens (formed between the fourth electrode receiving the focus voltage and the fifth electrode receiving the anode voltage) is enlarged to increase the capacity thereof.

However, with the above structure, as the CRT neck portion mounting the electron gun thereon is limited in its diameter, there is a limit in mechanically enlarging the opening diameter of the fourth and the fifth electrodes forming the main-focus lens. Such a limit is made because the electron gun formation electrodes need to be spaced apart from the inner surface of the neck portion by a predetermined distance to grant the withstand voltage characteristic to the CRT. Accordingly, as the opening diameter of the fourth and the fifth electrodes is established in a predetermined manner, it is difficult to achieve the desired electrode capacity in an effective manner.

SUMMARY OF THE INVENTION

It is an aspect of the present invention to provide a monochrome CRT electron gun for a projection display device which optimizes the spot size of electron beams emitted under the application of electric currents ranged from 0.5 mA to 2 mA.

It is another aspect of the present invention to provide a monochrome CRT electron gun for a projection display device which minimizes the degree of deterioration in the focus characteristic of electron beams scanning the periphery of the display screen.

According to one aspect of the present invention, the electron gun includes a cathode for emitting thermal electrons, a first electrode adjacent the cathode, and a second electrode adjacent the first electrode to receive a screen voltage and control the emission of thermal electrons from the cathode. A third electrode is adjacent the second electrode, and a fourth electrode is adjacent the third electrode to receive a focus voltage. A fifth electrode partially surrounds the fourth electrode while being adjacent the fourth electrode to receive an anode voltage together with the third electrode. The second electrode has a bottom portion with a stepped portion surrounding a hole for guiding the electron beams while being protruded toward the first electrode, and a sidewall portion extended from the periphery of the bottom portion toward the third electrode. The first and the second electrodes are structured to satisfy the following condition: $0.54 \leqq T/G \leqq 1.50$ where T(mm) indicates the thickness of the bottom portion of the second electrode, and G(mm) indicates the distance between the first and the second electrodes.

According to another aspect of the present invention, the electron gun includes a cathode for emitting thermal electrons, a first electrode adjacent the cathode, and a second electrode adjacent the first electrode to receive a screen voltage and control the emission of thermal electrons from the cathode. A third electrode is adjacent the second electrode, and a fourth electrode is adjacent the third electrode to receive a focus voltage. A fifth electrode partially surrounds the fourth electrode while being adjacent the fourth electrode to receive an anode voltage together with the third electrode. The second electrode has a bottom portion with a stepped portion surrounding a hole for guiding the electron beams while being protruded toward the first electrode, and a sidewall portion extended from the periphery of the bottom portion toward the third electrode. The first and the second electrodes are structured to satisfy the following condition: $0.15 \leqq T(mm) \leqq 0.3$, $0.20 \leqq G(mm) \leqq 0.28$ wherein T(mm) indicates the thickness of the bottom portion of the second electrode, and G(mm) indicates the distance between the first and the second electrodes.

The bottom portion and the stepped portion of the second electrode are preferably shaped with a circle while satisfying the following conditions: $0.08 \leqq D1/D2 \leqq 0.30$, $1.0 \leqq D1(mm) \leqq 3.0$ wherein D1(mm) indicates the diameter of the stepped portion of the second electrode, and D2(mm) indicates the diameter of the bottom portion of the second electrode.

The second electrode is structured to satisfy the following conditions: $0.02 \leqq H1/H2 \leqq 0.17$, $0.05 \leqq H1(mm) \leqq 0.30$ wherein H1(mm) indicates the height of the stepped portion of the second electrode, and H2(mm) indicates the height of the sidewall portion of the second electrode.

The stepped portion of the second electrode may be of non-circular shape.

More specifically, the stepped portion is rectangular-shaped with a long side proceeding in the vertical direction of the screen, and a short side proceeding in the horizontal direction. Alternatively, the stepped portion may be rectangular-shaped with a long side proceeding in the horizontal direction of the screen, and a short side proceeding in the vertical direction. Furthermore, the stepped portion may be oval-shaped with a long side proceeding in the vertical direction of the screen and a short side proceeding in the horizontal direction, or with a long side proceeding in the horizontal direction of the screen and a short side proceeding in the vertical direction.

DETAILED DESCRIPTION

Figure 1:
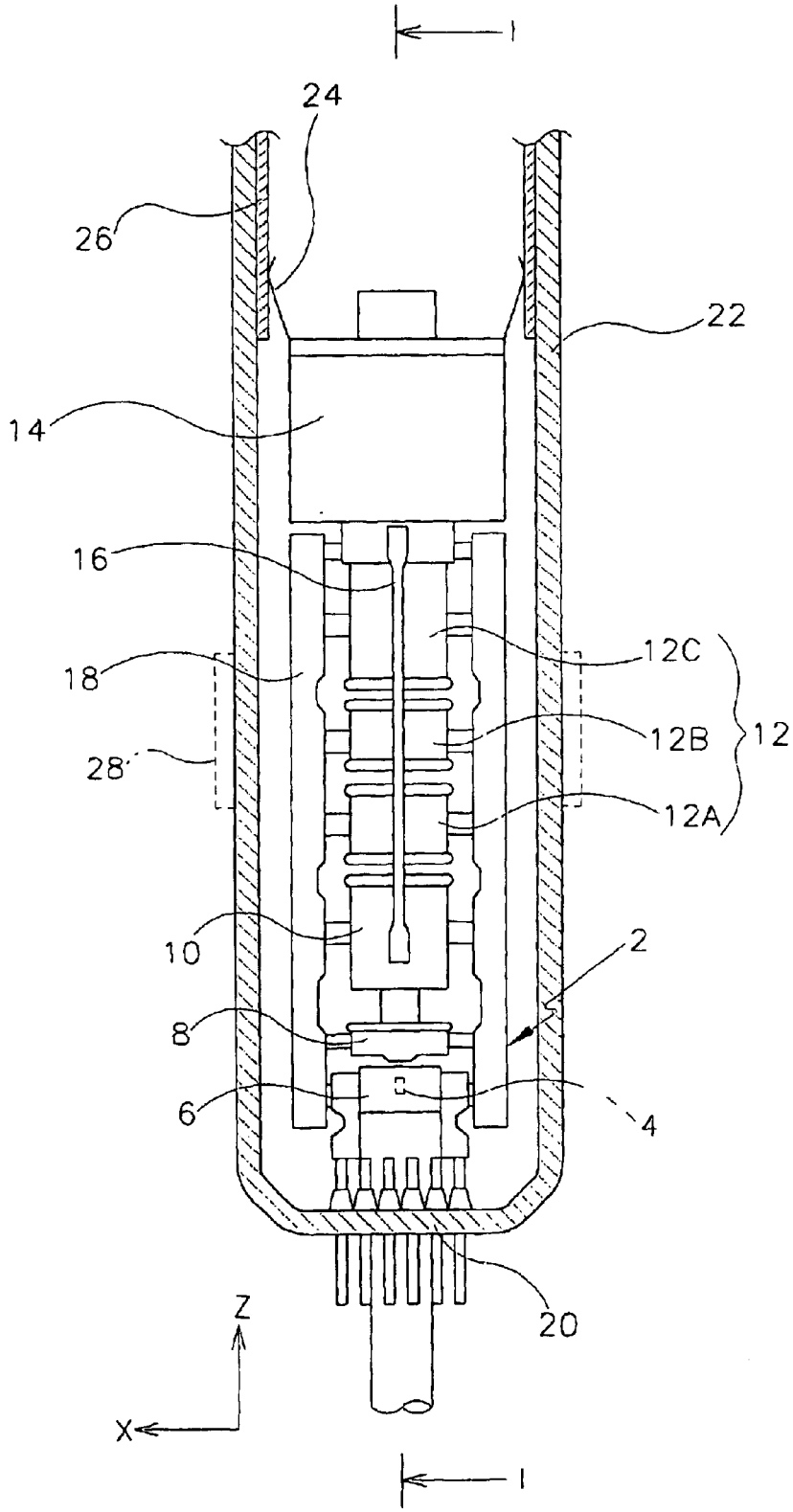
FIG. 1 is a front view of an electron gun for a CRT according to an embodiment of the present invention.
Figure 2:
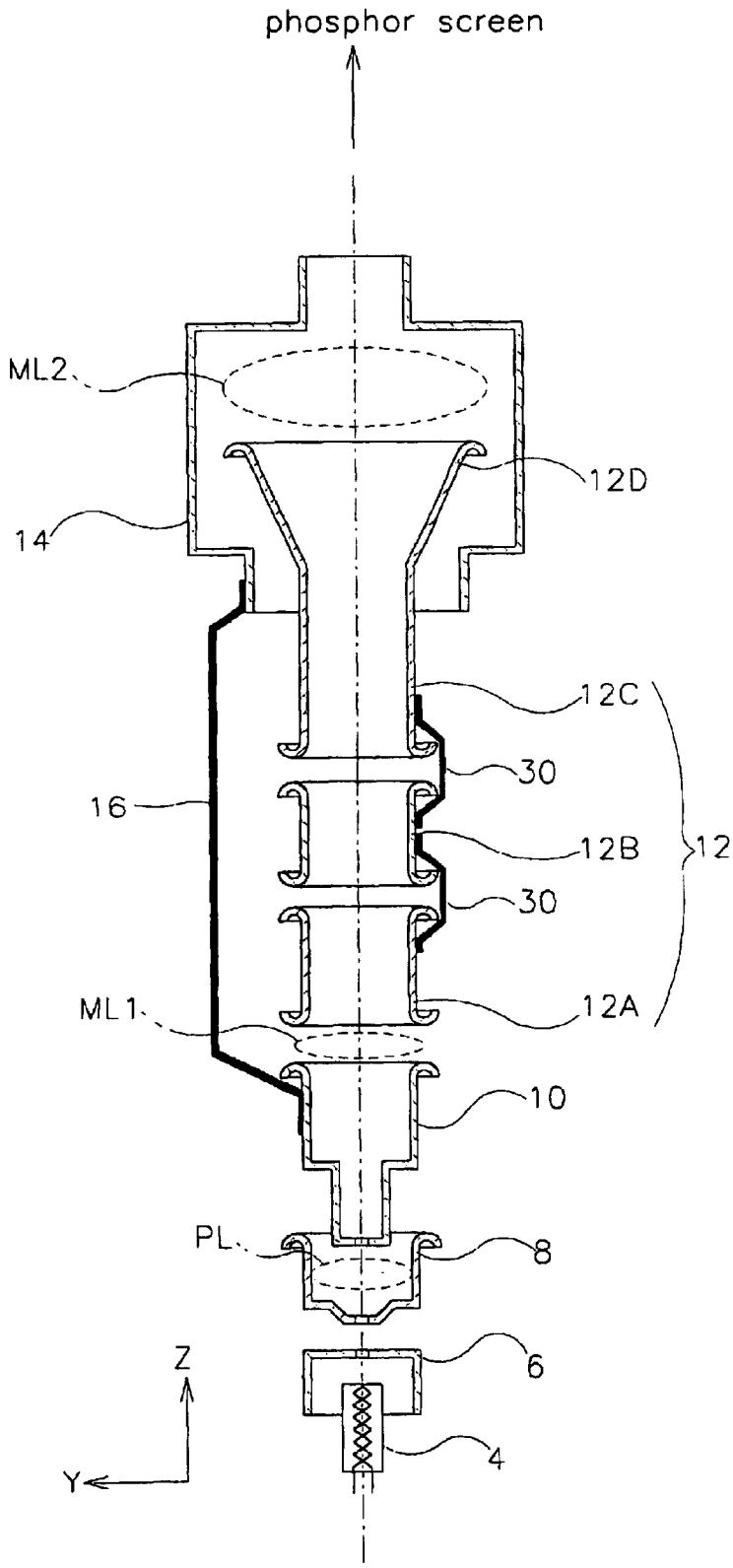
FIG. 2 is a cross sectional view of the electron gun taken along the I—I line of FIG. 1.

FIG. 1 is a front view of an electron gun for a CRT according to an embodiment of the present invention. FIG. 2 is a cross sectional view of the electron gun taken along the I—I line of FIG. 1. As shown in FIGS. 1 and 2, electron gun 2 includes cathode 4 for emitting thermal electrons, and first electrode 6 and second electrode 8 for forming a triode portion together with cathode 4 to control the emission of thermal electrons from cathode 4. Electron gun 2 further includes third electrode 10 adjacent second electrode 8, fourth electrode 12 adjacent third electrode 10 to receive the focus voltage, fifth electrode 14 partially surrounding fourth electrode 12 while being adjacent fourth electrode 12 to receive the anode voltage, and first connector 16 electrically connecting third electrode 10 and fifth electrode 14 to each other.

The afore-mentioned electrodes are fixed to bead glass 18, and arranged in the Z direction while proceeding from cathode 4. Stem base 20 mounting electron gun 2 thereon is fixed to the end of neck portion 22 such that electron gun 2 is placed within neck portion 22 while being spaced apart from the inner wall of neck portion 22 by a predetermined distance.

In operation, cathode 4 receives voltages of 50–190V. First electrode 6 is grounded such that it can make a predetermined voltage difference with respect to cathode 4. Second electrode 8 receives the screen voltage (approximately, several hundred volts) operated as a cut-off voltage, and controls the amount of electrons emitted from cathode 4.

Third electrode 10 commonly shares the anode voltage (approximately, 30–32 kV) together with fifth electrode 14 by way of first connector 16. Fourth electrode 12 receives the focus voltage, and particularly, the dynamic focus voltage of 7–10 kV. Fifth electrode 14 is electrically connected to graphite film 26 coated on the inner surface of neck portion 22 by way of bulb spacer 24 to receive the anode voltage from graphite film 26.

Accordingly, as seen in FIG. 2, pre-focus lens PL is formed between second electrode 8 and third electrode 10 due to the potential difference thereof. First main-focus lens ML1 is formed between third electrode 10 and fourth electrode 12 due to the potential difference thereof. Second main-focus lens ML2 is formed within fifth electrode 14 due to the potential difference between fourth electrode 12 fifth electrode 14.

When velocity modulator 28 is installed on the outer periphery of neck portion 22 to control the deflection velocity of the electron beams, fourth electrode 12 is partitioned into a plurality of sub-electrodes, including first sub-electrode 12A, second sub-electrode 12B and third sub-electrode 12C. In this case, the so-called VM gap is made between the respective sub-electrodes to enhance the sensitivity of velocity modulator 28.

When fourth electrode 12 is partitioned into a plurality of sub-electrodes, a pair of second connectors 30 electrically connect first sub-electrode 12A and second sub-electrode 12B as well as the second sub-electrode 12B and third sub-electrode 12C to each other such that the three sub-electrodes 12A, 12B and 12C commonly share the focus voltage.

Preferably, outermost third sub-electrode 12C of fourth electrode 12 distant from cathode 4 has outlet portion 12D with largest inner and outer diameters amongst the first to the third sub-electrodes 12A, 12B and 12C. Fifth electrode 14 surrounds outlet portion 12D of third sub-electrode 12C while being spaced apart from third sub-electrode 12C such that the equivalent diameter of second main-focus lens ML2 formed within fifth electrode 14 can be maximized.

With electron gun 2 according to the embodiment of the present invention, pre-focusing lens PL is controlled to realize an optimum electron beam spot size in the range of electric currents of 0.5–2 mA, usually applied to the monochrome CRT electron gun. For this purpose, the electron gun has a triode structure with an optimized electrode outline and an optimized inter-electrode distance.

Figure 3:
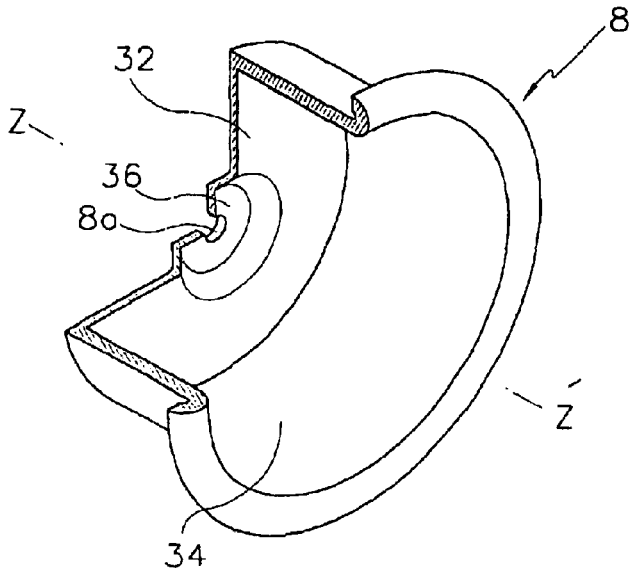
FIG. 3 is a partially elevated perspective view of a second electrode for the electron gun shown in FIG. 1.
Figure 4:
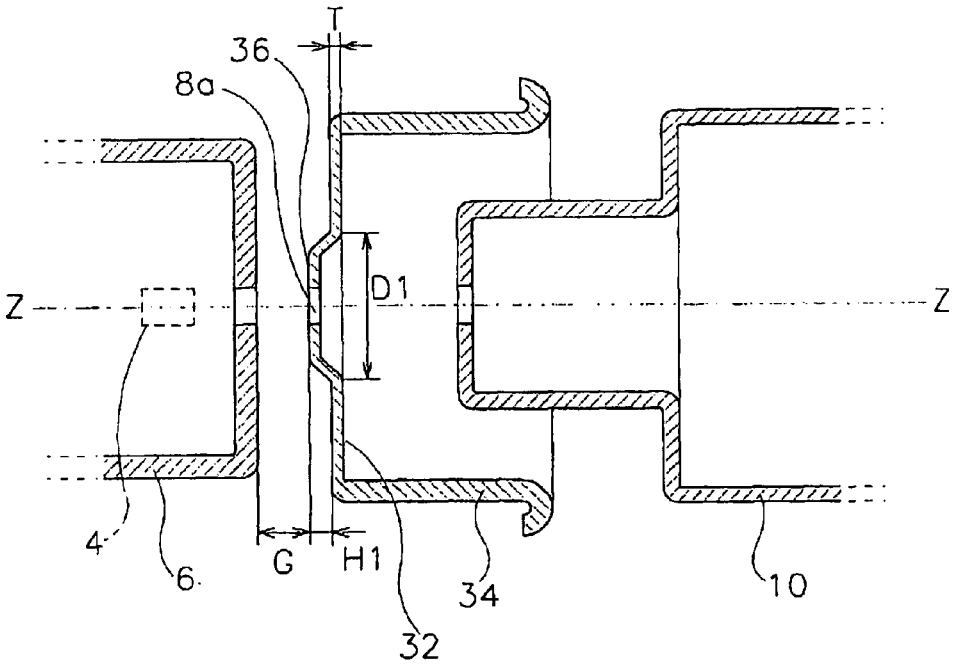
FIG. 4 is a partially amplified view of the electron gun shown in FIG. 2.

FIG. 3 is a partially elevated perspective view of the second electrode. FIG. 4 is a partially amplified view of the electron gun shown in FIG. 2. As shown in FIGS. 3 and 4, second electrode 8 is shaped with a cup. That is, second electrode 8 has bottom portion 32 with beam-guide hole 8*a*, and sidewall portion 34 extended from the periphery of bottom portion 32 toward third electrode 10. Stepped portion 36 is formed at bottom portion 32 while surrounding beam-guide hole 8*a*. Stepped portion 36 is protruded from bottom portion 32 toward first electrode 6 by a predetermined height. For instance, stepped portion 36 may be shaped with a circle having a predetermined diameter.

Particularly with second electrode 8, the thickness of bottom portion 32 with stepped portion 36 is established to be smaller than the thickness of sidewall portion 34. The reduction in the thickness of bottom portion 32 makes the spot size of electron beams change more sensitively to the variation in the electron beam currents. In other words, with the current range of 0.5–3 mA applied to the monochrome CRT electron gun, bottom portion 32 reduced in the thickness makes the spot size of electron beams in the lower current range of 0.5–2 mA be reduced.

Furthermore, as second electrode 8 has stepped portion 36 protruding toward first electrode 6, the distance between second electrode 8 and first electrode 6 is reduced. The reduction in the distance between first electrode 6 and second electrode 8 makes the crossover point of the electron beams move toward cathode 4, compared to the conventional electron gun. The movement in the crossover point of the electron beam, and the operation pursuant thereto will be explained with reference to FIGS. 5 and 6.

With electron gun 2 having the above-structured second electrode 8, the triode portion is established to satisfy the mathematical formula 1.

$$0.54 \leqq T/G \leqq 1.50 \quad (1)$$

wherein T indicates the thickness of bottom portion 32 of second electrode 8, and G indicates the distance between first electrode 6 and second electrode 8.

Particularly in this embodiment, second electrode 8 is structured such that the thickness T of bottom portion 32 satisfies the mathematical formula 2.

$$0.15 \leqq T(\text{mm}) \leqq 0.30 \quad (2)$$

Sidewall portion 34 of second electrode 8 is formed with a thickness of about 0.4 mm. Even though the thickness of bottom portion 32 is smaller than that of sidewall portion 34, stepped portion 36 reinforces bottom portion 32 to give a predetermined structural strength thereto.

Furthermore, the distance G between second electrode 8 and first electrode 6 is reduced by way of stepped portion 36 while satisfying the mathematical formula 3.

$$0.20 \leqq G(\text{mm}) \leqq 0.28 \quad (3)$$

Figure 5:
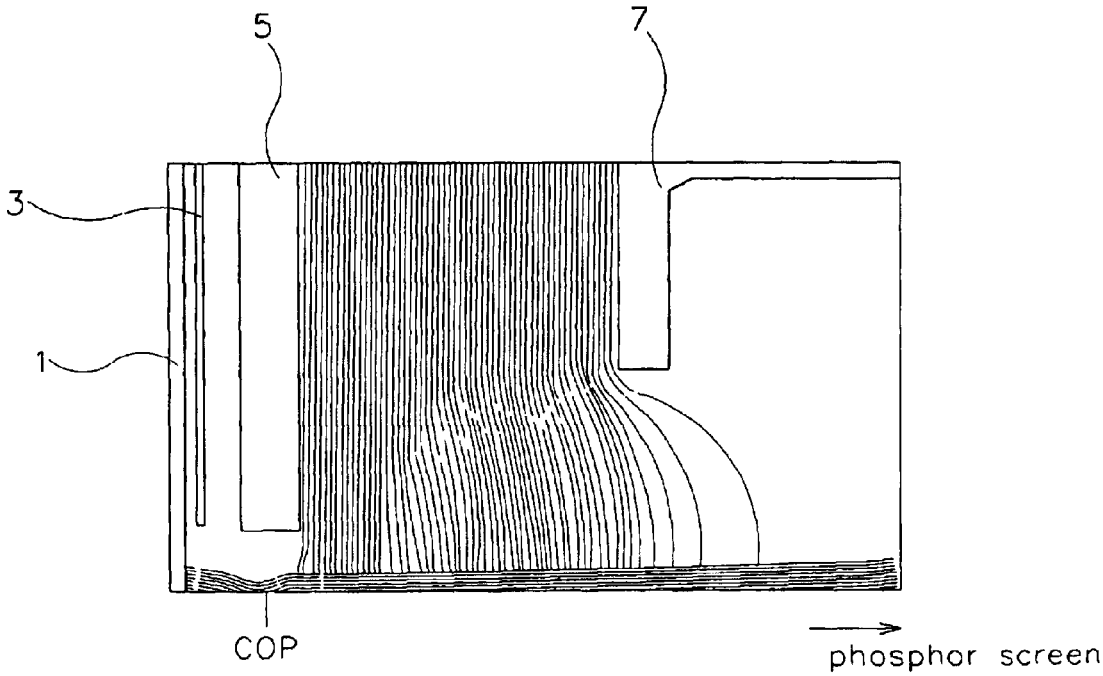
FIG.5(Prior Art)
FIG. 5 schematically illustrates the equi-potential lines and the electron beam locus formed at the triode portion with the driving of an electron gun according to a prior art.
Figure 6:
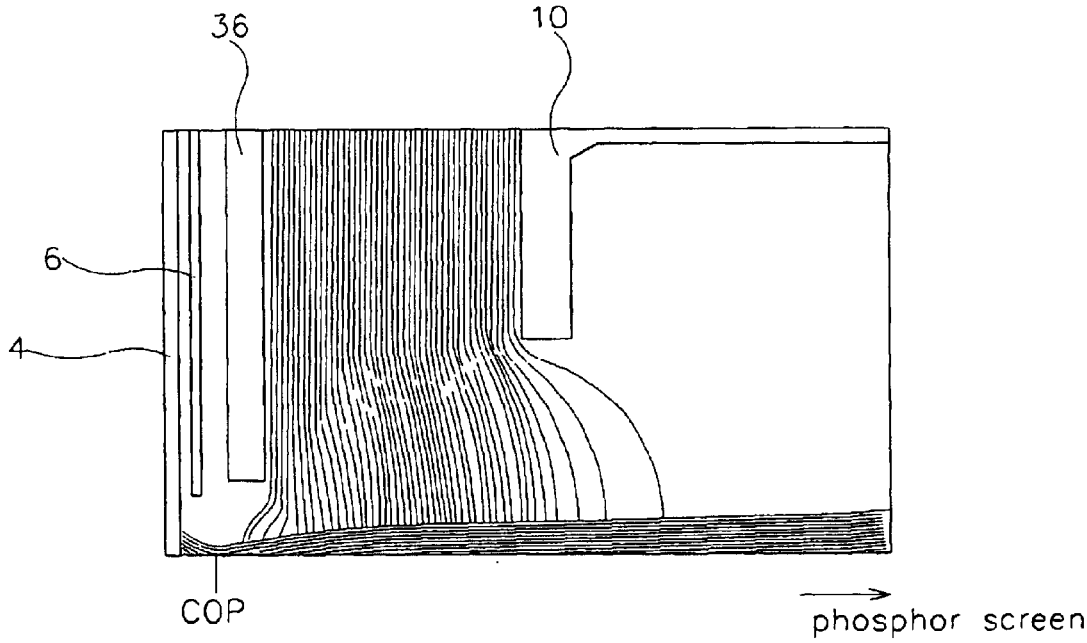
FIG. 6 schematically illustrates the equi-potential lines and the electron beam locus formed at the triode portion with the driving of an electron gun according to an embodiment of the present invention.

FIGS. 5 and 6 schematically illustrate the equi-potential lines and the electron beam locus formed at a triode portion with the driving of an electron gun according to a prior art (Comparative Example 1), and an electron gun according to an embodiment of the present invention (Example 1). In the drawings, reference numeral 1 indicates the cathode, reference numeral 3 indicates the first electrode, reference numeral 5 indicates the bottom portion of the second electrode, and reference numeral 7 indicates the third electrode. For the purpose of explanatory convenience, only stepped portion 36 of the second electrode is specifically illustrated in FIG. 6.

With the electron guns according to the embodiment of the present invention and according to the prior art, only the triode portion is differentiated from each other. The case illustrated in the drawings is made such that the first electrode is grounded, a voltage of 500V is applied to the second electrode, and a voltage of 32 kV is applied to the third electrode. The structural characteristics of the triode portions for the electron guns are listed in Table 1.

TABLE 1

| | Distance (mm) between first and second electrodes | Thickness (mm) of bottom portion of second electrode | Diameter (mm) of stepped portion | Height (mm) of stepped portion |
|---|---|---|---|---|
| Example | 0.25 | 0.20 | 2.00 | 0.20 |
| Comparative Example | 0.30 | 0.40 | — | — |

It can be seen from FIG. 5 that with the electron gun according to the prior art, the crossover point (COP) of the electron beams focused at the triode portion by way of the pre-focus lens is positioned at the location distant from cathode 1 by 0.58 mm. The electron beams passing the crossover point (COP) proceed toward third electrode 7 while being diffused at an angle of lower degrees.

In contrast, it can be seen from FIG. 6 that with the electron gun according to the embodiment of the present invention, the crossover point (COP) of the electron beams focused at the triode portion by way of a pre-focus lens is positioned at the location distant from cathode 4 by 0.42 mm. The electron beams passing the crossover point (COP) proceed toward the third electrode 10 while being diffused at an angle of higher degrees.

As described above, the crossover point of the electron beams with electron gun 2 according to the embodiment of the present invention comes closer to cathode 4, compared to the electron gun according to the prior art. This strengthens the emission force of the electron beams toward first main-focus lens ML1, and makes the spot size of the electron beams landing on the phosphor screen be reduced.

Figure 7:
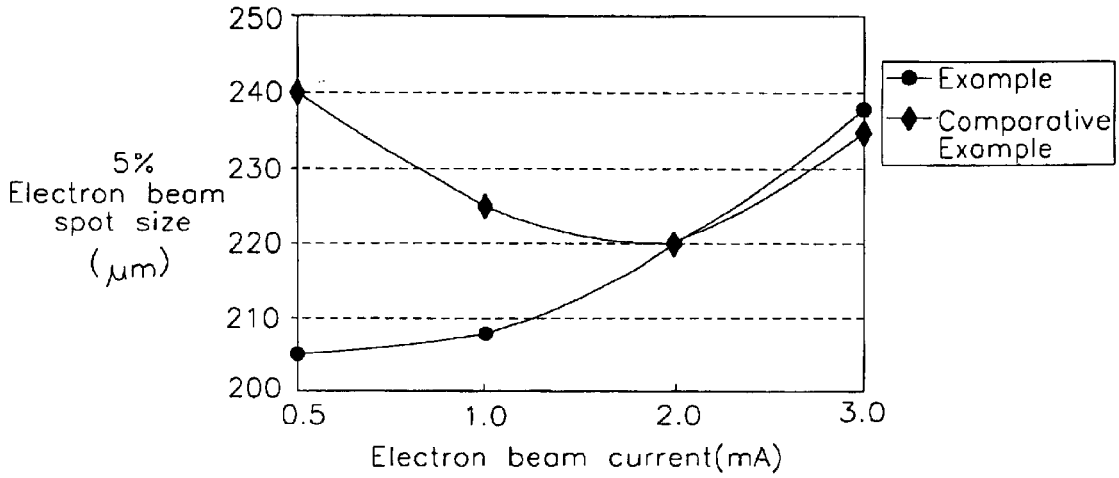
FIG. 7 is a graph illustrating the spot size of 5% of the electron beams as a function of the variation in the applied electric currents with an electron gun according to an embodiment of the present invention, and an electron gun according to a prior art.

Table 2 and FIG. 7 illustrate the results of measuring the spot size of 5% of the electron beams as a function of the variation in the electron beam currents with an electron gun according to an embodiment of the present invention (Example), and an electron gun according to a prior art (Comparative Example).

TABLE 2

| | | | | | |
|---|---|---|---|---|---|
| Electron beam current (mA) | | 0.5 | 1.0 | 2.0 | 3.0 |
| 5% electron beam spot size (μm) | Comparative Example | 240.0 | 225.0 | 220.0 | 235.0 |
| | Example | 205.0 | 207.5 | 220.0 | 238.0 |
| Electron beam spot size reduction rate (%) | | 14.6 | 7.8 | 0 | −1.3 |

With the practical range of electric currents of 0.5–3 mA applied to the monochrome CRT electron gun, the electron gun according to the embodiment of the present invention involves reduction in the spot size of the electron beams in the lower current range of 0.5–2 mA, and the beam spot size reduction rate maximally reaches 14.6%.

Further, as an additional effect pursuant to the above structural modification, the electron gun according to the embodiment of the present invention involves a variation in the cut-off characteristic. The focus characteristic in the higher current range of more than 2 mA and in the condition of scanning the periphery of the display screen due to the deflection of the electron beams can be prevented from being deteriorated.

First, the variation in the cut-off characteristic will be now explained.

Figure 8:
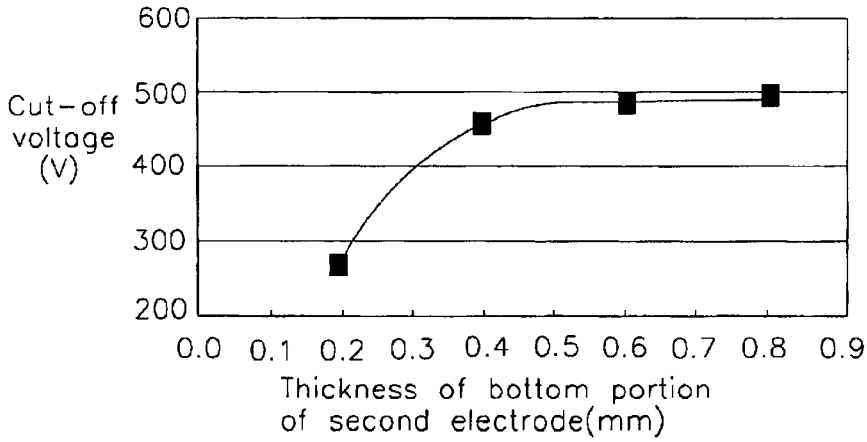
FIG. 8 is a graph illustrating the relation of the bottom thickness of a second electrode to the cut-off voltage.

FIG. 8 is a graph illustrating the relation of the bottom thickness of the second electrode to the cut-off voltage. It can be seen from FIG. 8 that as the thickness of bottom portion 32 of second electrode 8 is reduced, the cut-off voltage required for emitting the thermal electrons is decreased. As the thickness of bottom portion 32 of second electrode 8 is determined to be in the range of 0.15–0.30 mm, the cut-off voltage is lowered to be in the range of 300–400V, compared to the conventional one reaching up to 500V.

The decrease in the cut-off voltage is made because the high anode voltage applied to third electrode 10 influences the inside of second electrode 8, and more strongly focuses the electron beams emitted from cathode 4. Accordingly, electron gun 2 according to the embodiment of the present invention is operated with a low screen voltage, thereby serving to reduce the production cost of the CRT, and improve the display quality thereof.

Figure 9:
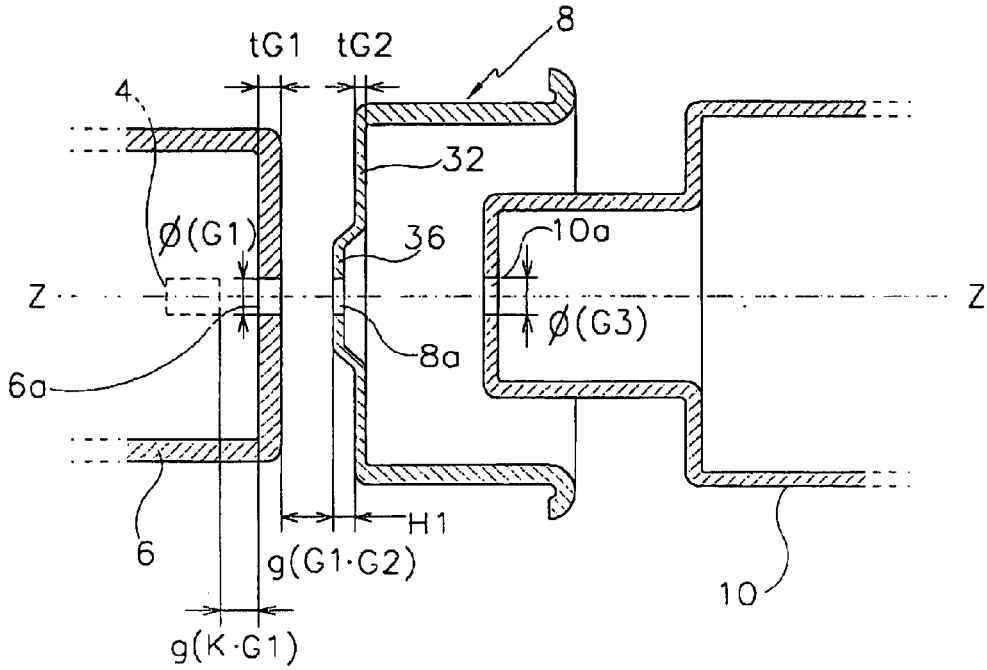
FIG. 9 is a partially amplified view of the electron gun shown in FIG. 2.

Electron gun 2 with the above-described triode structure is given with a new cut-off formulation expressed by mathematical formula 4.

$$\text{Cut-off voltage } (V) = k\frac{\phi(G1)\times\phi(G3)}{g(G1\cdot G2)\times g(K\cdot G1)\times tG1\times 2^{tG2}}\times Ec2\times Eb. \quad (4)$$

wherein k indicates a constant, ϕ(G1) indicates the diameter of beam-guide hole 6*a* of first electrode 6, ϕ(G3) indicates the diameter of beam-guide hole 10*a* of third electrode 10, g(G1·G2) indicates the distance between first electrode 6 and second electrode 8, g(K·G1) indicates the distance between cathode 4 and first electrode 6, tG1 indicates the thickness of first electrode 6, tG2 indicates the thickness of bottom portion 32 of second electrode 8, Ec2 indicates the screen voltage applied to second electrode 8, and Eb indicates the anode voltage applied to third electrode 10 (referring to FIG. 9).

The focus characteristic of the electron beams in the higher current range of more than 2 mA and in the condition of scanning the periphery of the display screen by way of the deflected electron beams will be now explained.

As shown in FIG. 9, stepped portion 36 of second electrode 8 is protruded from bottom portion 32 of second electrode 8 toward first electrode 6 by a predetermined height, and hence, takes a role of enlarging the distance between the center of bottom portion 32 of second electrode 8 surrounding beam-guide hole 8*a*, and third electrode 10.

With the above structure, the electron beams in the lower current range of 2 mA or less are largely diffused toward pre-focus lens PL while being reduced in their spot size. In the higher current range of more than 2 mA and in the condition of deflecting the electron beams, pre-focus lens PL is reinforced so that the electron beams move along the paraxial trace, and hence, the focus characteristic is prevented from being deteriorated.

Accordingly, with electron gun 2 according to the embodiment of the present invention, the reasonable focus characteristic over the center and the periphery of the display screen is maintained in the current range of 0.5–3 mA applied to the monochrome CRT electron gun, thereby improving the resolution of the projection screen.

Figure 10:
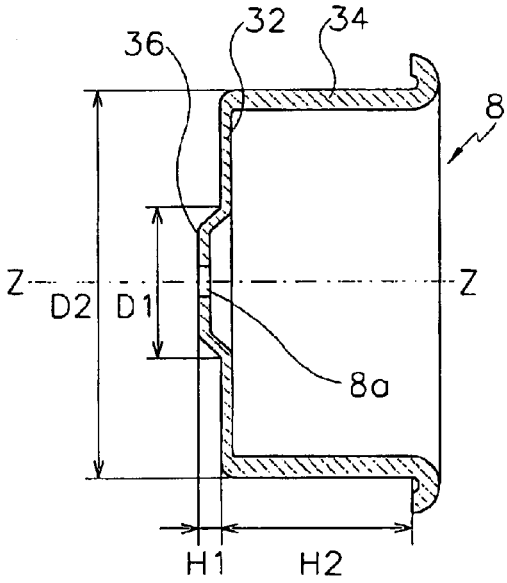
FIG. 10 is an amplified view of a second electrode for the electron gun shown in FIG. 2.

FIG. 10 is a cross sectional view of second electrode 8. In this embodiment, stepped portion 36 of second electrode 8 is structured to satisfy the mathematical formula 5 or 6. Consequently, stepped portion 36 of second electrode 8 bears a sufficient influential power with respect to pre-focus lens PL.

$$0.08 \leqq D1/D2 \leqq 0.30 \quad (5)$$

$$1.0 \leqq D1(\text{mm}) \leqq 3.0 \quad (6)$$

In the mathematical formulas 5 and 6, D1 indicates the diameter of stepped portion 36 of second electrode 8, and D2 indicates the diameter of bottom portion 32 of second electrode 8.

Furthermore, stepped portion 36 is established to satisfy the mathematical formula 7 or 8 such that the withstand voltage characteristic between first electrode 6 and second electrode 8 can be maintained. Consequently, the formation of second electrode 8 is made in an easy manner, and pre-focus lens PL in the higher current range of more than 2 mA and in the condition of deflecting the electron beams is reinforced, thereby improving the focus characteristic of the electron beams.

$$0.02 \leqq H1/H2 \leqq 0.17 \quad (7)$$

$$0.05 \leqq H1(\text{mm}) \leqq 0.30 \quad (8)$$

In the mathematical formulas 7 and 8, H1 indicates the height of stepped portion 36 of second electrode 8 in the Z direction, and H2 the height of sidewall portion 34 of second electrode 8.

Further, with the usual monochrome CRT electron gun, circular electrode and lens structures are commonly used. In recent times, studies on the electron guns adapted for a wide CRT where the ratio of the horizontal length to the vertical length of the screen is 16:9 have been made. Particularly, studies on the electron gun structure where the beam spot sizes in the horizontal axis direction and in the vertical axis direction are non-symmetrically determined have been made to improve the focus characteristic at the periphery of the display screen.

In this connection, electron gun 2 according to the embodiment of the present invention makes beam-guide hole 8*a* of second electrode 8 be shaped with a circle while altering the shape of stepped portion 36 of second electrode 8 in various manners, such as a circle, an oval, and a rectangle. Consequently, the inter-electrode alignment of the beam-guide holes is made in an easy manner while being well adapted for the wide screening and the non-symmetrical beam spot outlining.

FIGS. 11 to 14 schematically illustrate variations of the stepped portion of the second electrode.

Figure 11:
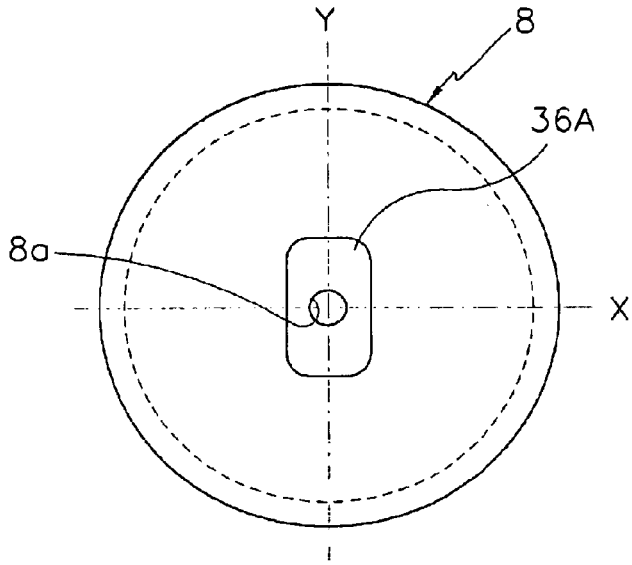
FIGS. 11 to 14 schematically illustrate variations of a stepped portion of a second electrode for an electron gun according to an embodiment of the present invention.
Figure 12:
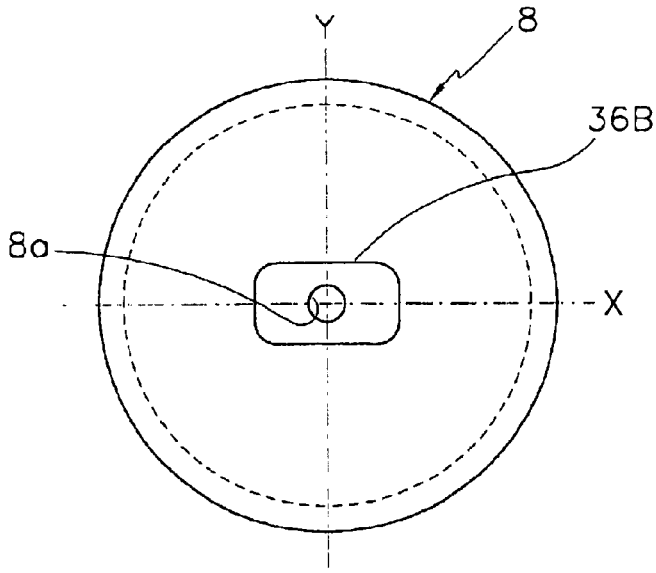

As shown in FIGS. 11 and 12, stepped portions 36A and 36B may be shaped with a rectangle. That is, as shown in FIG. 11, stepped portion 36A of second electrode 8 is rectangular-shaped with a long side proceeding in the vertical direction (in the Y direction) of the screen, and a short side proceeding in the horizontal direction (in the X direction). Alternatively, as shown in FIG. 12, stepped portion 36B of second electrode 8 may be rectangular-shaped with a long side proceeding in the horizontal direction (in the X direction), and a short side proceeding in the vertical direction (in the Y direction).

Figure 13:
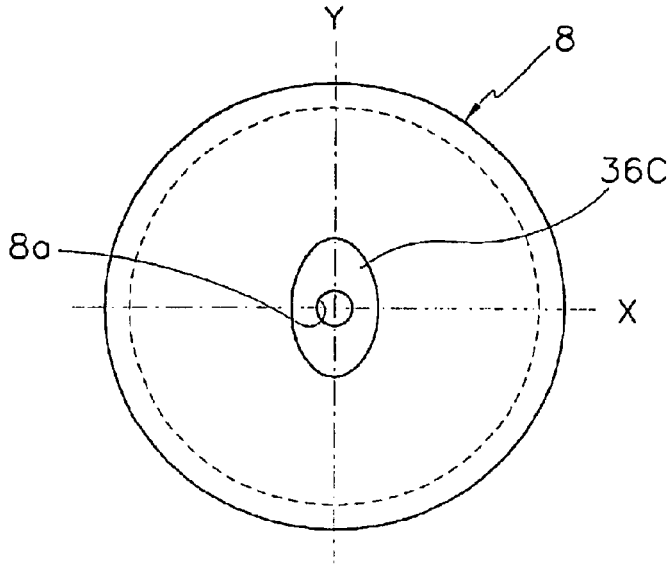
Figure 14:
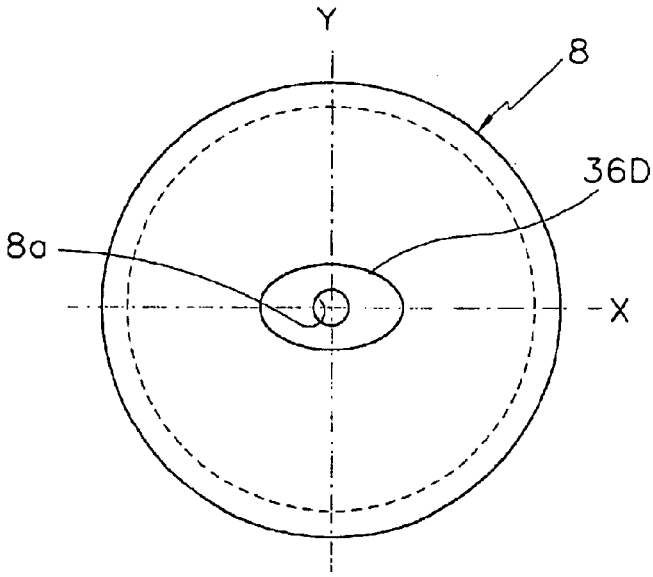

As shown in FIGS. 13 and 14, stepped portions 36C and 36D may be shaped with an oval. That is, as shown in FIG. 13, stepped portion 36C of second electrode 8 is oval-shaped with a long side proceeding in the vertical direction (in the Y direction) of the screen, and a short side proceeding in the horizontal direction (in the X direction). Alternatively, as shown in FIG. 14, stepped portion 36D of second electrode 8 may be oval-shaped with a long side proceeding in the horizontal direction (in the X direction), and a short side proceeding in the vertical direction (in the Y direction).

As described above, the shape of second electrode 8 and the distance between first electrode 6 and second electrode 8 are altered to effectively reduce the beam spot size in the current range of 0.5–2 mA, where the monochrome CRT is practically operated. Furthermore, stepped portion 36 formed at second electrode 8 prevents the focus characteristic of the electron beams in the higher current region of more than 2 mA and in the condition of deflecting the electron beams from being deteriorated.

While the present invention has been described in detail with reference to certain embodiments, those skilled in the art will appreciate that various modifications and substitutions can be made thereto without departing from the spirit and scope of the present invention as set forth in the appended claims.

What is claimed is:

1. An electron gun for a cathode ray tube comprising:

a cathode for emitting thermal electrons;

a first electrode adjacent the cathode;

a second electrode adjacent the first electrode to receive a screen voltage and control the emission of thermal electrons from the cathode;

a third electrode adjacent the second electrode;

a fourth electrode adjacent the third electrode to receive a focus voltage; and a fifth electrode partially surrounding the fourth electrode while being adjacent the fourth electrode to receive an anode voltage together with the third electrode;

wherein the second electrode has a bottom portion with a stepped portion surrounding a hole for guiding the electron beams while being protruded toward the first electrode, and a sidewall portion extended from the periphery of the bottom portion toward the third electrode;

wherein the first electrode and the second electrode are structured to satisfy the following condition:

$$0.54 \leqq T/G \leqq 1.50$$

T(mm) indicating the thickness of the bottom portion of the second electrode, and G(mm) indicating the distance between the first and the second electrodes.

2. The electron gun of claim 1, wherein the second electrode is structured to satisfy the following condition:

$$0.15 \leqq T(\text{mm}) \leqq 0.3$$

T(mm) indicating the thickness of the bottom portion of the second electrode.

3. The electron gun of claim 1, wherein the first and the second electrodes are structured to satisfy the following condition:

$$0.20 \leqq G(\text{mm}) \leqq 0.28$$

G(mm) indicating the distance between the first and the second electrodes.

4. The electron gun of claim 1, wherein the cut-off voltage (V) is established to satisfy the following condition:

$$V = k\frac{\phi(G1)\times\phi(G3)}{g(G1\cdot G2)\times g(K\cdot G1)\times tG1\times 2^{tG2}}\times Ec2\times Eb$$

k indicating a constant, ϕ(G1) indicating the diameter of the beam-guide hole of the first electrode, ϕ(G3) indicating the diameter of the beam-guide hole of the third electrode, g(G1·G2) indicating the distance between the first and the second electrodes, g(K·G1) indicating the distance between the cathode and the first electrode, tG1 indicating the thickness of the first electrode, tG2 indicating the thickness of the bottom portion of the second electrode, Ec2 indicating the screen voltage applied to the second electrode, and Eb indicating the anode voltage applied to the third electrode.

5. The electron gun of claim 1, wherein the bottom portion and the stepped portion of the second electrode are circular-shaped.

6. The electron gun of claim 5, wherein the second electrode is structured to satisfy the following condition:

$$0.08 \leqq D1/D2 \leqq 0.30$$

D1(mm) indicating the diameter of the stepped portion of the second electrode, and D2(mm) indicating the diameter of the bottom portion of the second electrode.

7. The electron gun of claim 5, wherein the second electrode is structured to satisfy the following condition:

$$1.0 \leqq D1(\text{mm}) \leqq 3.0$$

D1(mm) indicating the diameter of the stepped portion of the second electrode.

8. The electron gun of claim 1, wherein the second electrode is structured to satisfy the following condition:

$$0.02 \leqq H1/H2 \leqq 0.17$$

H1(mm) indicating the height of the stepped portion of the second electrode, and H2(mm) indicating the height of the sidewall portion of the second electrode.

9. The electron gun of claim 1, wherein the second electrode is structured to satisfy the following condition:

$$0.05 \leqq H1(\text{mm}) \leqq 0.30$$

H1(mm) indicating the height of the stepped portion of the second electrode.

10. The electron gun of claim 1, wherein the stepped portion of the second electrode is non-circular shaped.

11. The electron gun of claim 10, wherein the stepped portion is rectangular-shaped with a long side proceeding in the vertical direction of the screen, and a short side proceeding in the horizontal direction.

12. The electron gun of claim 10, wherein the stepped portion is rectangular-shaped with a long side proceeding in the horizontal direction of the screen, and a short side proceeding in the vertical direction.

13. The electron gun of claim 10, wherein the stepped portion is oval-shaped with a long side proceeding in the vertical direction of the screen, and a short side proceeding in the horizontal direction.

14. The electron gun of claim 10, wherein the stepped portion is oval-shaped with a long side proceeding in the horizontal direction of the screen, and a short side proceeding in the vertical direction.

15. An electron gun for a cathode ray tube comprising:

a cathode for emitting thermal electrons;

a first electrode adjacent the cathode;

a second electrode adjacent the first electrode to receive a screen voltage and control the emission of thermal electrons from the cathode;

a third electrode adjacent the second electrode;

a fourth electrode adjacent the third electrode to receive a focus voltage; and a fifth electrode partially surrounding the fourth electrode while being adjacent the fourth electrode to receive an anode voltage together with the third electrode;

wherein the second electrode has a bottom portion with a stepped portion surrounding a hole for guiding the electron beams while protruding toward the first electrode, and a sidewall portion extended from the periphery of the bottom portion toward the third electrode;

wherein the first and the second electrodes are structured to satisfy the following condition:

$$0.15 \leqq T(\text{mm}) \leqq 0.3,\ 0.20 \leqq G(\text{mm}) \leqq 0.28$$

T(mm) indicating the thickness of the bottom portion of the second electrode, and G(mm) indicating the distance between the first and the second electrodes.

16. The electron gun of claim 15, wherein the bottom portion and the stepped portion of the second electrode are circular-shaped.

17. The electron gun of claim 16, wherein the second electrode is structured to satisfy the following condition:

$$0.08 \leqq D1/D2 \leqq 0.30$$

D1(mm) indicating the diameter of the stepped portion of the second electrode, and D2(mm) indicating the diameter of the bottom portion of the second electrode.

18. The electron gun of claim 16, wherein the second electrode is structured to satisfy the following condition:

$$1.0 \leqq D1(\text{mm}) \leqq 3.0$$

D1(mm) indicating the diameter of the stepped portion of the second electrode.

19. The electron gun of claim 15, wherein the second electrode is structured to satisfy the following condition:

$$0.02 \leqq H1/H2 \leqq 0.17$$

H1(mm) indicating the height of the stepped portion of the second electrode, and H2(mm) indicating the height of the sidewall portion of the second electrode.

20. The electron gun of claim 15, wherein the second electrode is structured to satisfy the following condition:

$$0.05 \leqq H1(\text{mm}) \leqq 0.30$$

H1(mm) indicating the height of the stepped portion of the second electrode.

* * * * *